US010107029B1

(12) United States Patent
Ceballos

(10) Patent No.: US 10,107,029 B1
(45) Date of Patent: Oct. 23, 2018

(54) WINDOW FOR DISPOSING OF GARBAGE THERETHROUGH

(71) Applicant: Jose Ceballos, Palmdale, CA (US)

(72) Inventor: Jose Ceballos, Palmdale, CA (US)

( * ) Notice: Subject to any disclaimer, the term of this patent is extended or adjusted under 35 U.S.C. 154(b) by 297 days.

(21) Appl. No.: 14/810,412

(22) Filed: Jul. 27, 2015

Related U.S. Application Data

(60) Provisional application No. 62/030,208, filed on Jul. 29, 2014.

(51) Int. Cl.

| | |
|---|---|
| ***E06B 5/00*** | (2006.01) |
| ***E05D 15/16*** | (2006.01) |
| ***E06B 1/06*** | (2006.01) |
| ***E06B 1/36*** | (2006.01) |
| ***E06B 3/36*** | (2006.01) |
| ***E06B 3/44*** | (2006.01) |

(52) U.S. Cl.
CPC ..... *E06B 5/00* (2013.01); *E05D 15/165* (2013.01); *E06B 1/06* (2013.01); *E06B 1/36* (2013.01); *E06B 3/36* (2013.01); *E06B 3/4407* (2013.01); *E05Y 2201/602* (2013.01); *E05Y 2600/452* (2013.01); *E05Y 2800/10* (2013.01); *E05Y 2800/71* (2013.01)

(58) Field of Classification Search
CPC . E06B 5/00; E06B 3/4407; E06B 3/36; E05Y 2800/10; E05Y 2201/602
USPC ..... 49/161, 162
See application file for complete search history.

(56) References Cited

U.S. PATENT DOCUMENTS

| | | | | |
|---|---|---|---|---|
| 1,441,040 | A | 11/1918 | Stephenson | |
| 1,403,575 | A * | 1/1922 | Sheehan | E06B 3/44 292/239 |
| 3,427,747 | A * | 2/1969 | Ober, Sr. | E05C 7/02 49/162 |
| 3,554,345 | A * | 1/1971 | Mullens | B65F 1/0093 193/33 |
| 4,133,143 | A * | 1/1979 | Campisano | E05D 15/22 16/390 |
| 5,228,577 | A | 7/1993 | Wilson | |
| 6,641,193 | B2 | 11/2003 | Alkevicius | |
| 9,022,089 | B1 * | 5/2015 | Dau | E06B 9/54 160/30 |
| 2015/0259972 | A1 * | 9/2015 | Yi | E05B 53/003 160/159 |

* cited by examiner

*Primary Examiner* — Gregory J Strimbu
(74) *Attorney, Agent, or Firm* — RG Patent Consulting, LLC; Rachel Gilboy

(57) ABSTRACT

An apparatus for disposing of trash, including garbage and recyclables, through a pair of adjacent trash removal windows separated by a spacer into separate outdoor trash containers without having to leave a building. Each of the pair of trash removal windows are independently raised respective one of the trash containers simultaneously with the lid of a trash container so a user can dispose of trash through the opened window into the trash container. When the window is closed the lid of the trash container is closed at the same time.

5 Claims, 6 Drawing Sheets

WINDOW FOR DISPOSING OF GARBAGE THERETHROUGH

CROSS-REFERENCE TO RELATED APPLICATION

The present application is related to and claims priority from prior provisional application Ser. No. 62/030,208, filed Jul. 29, 2014 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of windows and more specifically relates to a disposable window.

2. Description of the Related Art

Every household accumulates trash in the form of garbage destined for a dump location and items able to be recycled. Forty years after capturing the imagination of many people during the first observance of Earth Day, America's recycling revolution is getting mixed reviews. On the one hand, recycling has become ingrained enough that today 140 million Americans recycle—more than vote in national elections.

The most recent figures suggest that recycled waste accounts for more than 30 percent of all waste generated by American households. On the other hand, in the past 10 years, the share of waste that is recycled has grown very slowly. Some experts see a fading commitment on the part of the public to push toward recycling fully half of all waste material—a target that many advocates insist is still achievable. Others note that recycling gains have been seriously undermined by the fact that each American today generates and throws away almost 50 percent more trash than we did in 1970. Still others say recycling needs to break out of its current emphasis on households and break through to businesses, which account for 75 percent of the total domestic wastes generated.

In any event, households generate garbage and recyclables every day and must dispose of them. In many towns and cities, the local solid waste authority provides citizens with separate trash bins for garbage and recyclables that are kept outdoors and are able to be placed at the curb on a regular schedule for pick-up. Many households have quarrels about who is "taking out the trash." Most people don't want to do it because it involves wearing clothing appropriate for the outdoor conditions and carrying the trash from the interior of the house to the outdoor location of the trash bins. Many households would love to be able to easily dispose of their trash by merely opening a window and placing the trash through the window into one of the trash bins used for either garbage or recyclables. These households would also appreciate a mechanism that would simultaneously open the window and the lid of the appropriate trash bin and then close the trash bin lid when the window is closed.

Various attempts have been made to solve the above-mentioned problems such as those found in U.S. Pat. No. 5,228,577 to Terry D. Wilson; U.S. Pat. No. 1,441,040 to C. H. Stephenson; and U.S. Pat. No. 6,641,193 to David Alkevicius. This art is representative of windows. None of the above inventions and patents, taken either singly or in combination, is seen to describe the invention as claimed.

Ideally, a disposable window should provide a window used in conjunction with outside trash containers to improve the ability of removing trash from a house and, yet would operate reliably and be manufactured at a modest expense. Thus, a need exists for a reliable disposable window to avoid the above-mentioned problems.

BRIEF SUMMARY OF THE INVENTION

In view of the foregoing disadvantages inherent in the known windows art, the present invention provides novel disposable windows. The general purpose of the present invention, which will be described subsequently in greater detail is to provide an apparatus for disposing of trash, including garbage and recyclables, through a pair of adjacent windows separated by a spacer into separate outdoor trash containers without having to leave a building.

Disposable windows are disclosed herein, in a preferred embodiment, comprising a first trash removal frame adapted to be fixedly inserted into the side of a building, comprising a house, via a first cut out on a side of the house and a second trash removal frame adapted to be fixedly inserted into the side of the house via a second cut out on the side of the house. The first cut out and the second cut out are adapted to be separated by a spacer and are adapted to provide an alignment of the first trash removal frame with a first trash container and the alignment of the second trash removal frame provides an alignment with a second trash container.

Each of the first trash removal frame and the second trash removal frame is constructed of wood material and comprise a unit width, a unit height, and a unit depth. The unit depth is adapted and sized to match a standard depth of the side of the building.

A first trash removal frame including a first window has a first means for raising and lowering the first window and a first means for lifting a first trash container lid, and a first door having a first means for opening and closing the first door. The first window is moveably attached to an interior lower half of the first trash removal frame and the first door is fixedly attached to an exterior top half of the first trash removal frame.

The first means for raising and lowering the first window comprises a first pair of tracks and a first plurality of rollers to raise and lower the first window. The first pair of tracks of the first means for raising and lowering the first window comprises a first track fixedly attached to an interior left side of the first trash removal frame and a second track fixedly attached to an interior right side of the first trash removal frame.

The first plurality of rollers of the first means for raising and lowering the first window comprises a first roller fixedly attached via a first roller attachment to an interior left bottom corner of the first window, a second roller fixedly attached via a second roller attachment to an interior left top corner of the first window, a third roller fixedly attached via a third roller attachment to an interior right bottom corner of the first window, and a fourth roller fixedly attached via a fourth roller attachment to an interior right top corner of the first window. The first window is raised and lowered via the first roller, the second roller, the third roller and the fourth roller traversing simultaneously respectively up and down the first track and the second track.

The first means for lifting the first trash container lid is adapted to raise and lower the first trash container lid and comprises a first cable having a first end fixedly attached to the first window and a second end adapted to be removably attached to the first trash container lid (note: the first trash container is not being set forth as part of the invention). The first means for lifting the first trash container lid is adapted to raise and lower the first trash container lid and the first window simultaneously via the first end of the first cable fixedly attached to a bottom edge of the first window and the second end of the first cable that is adapted to be removably attached to the first trash container lid via a first clamp adapted to be held in place via squeezing pressure.

The first means for opening and closing the first door opens and closes the first door via a first plurality of hinges fixedly attached by screws and evenly spaced along an exterior left side of the first door. The first door opens and closes horizontally.

A second trash removal frame including a second window has a second means for raising and lowering the second window and a second means for lifting a second trash container lid, and a second door having a second means for opening and closing the second door. The second window is moveably attached to an interior lower half of the second trash removal frame.

The second means for raising and lowering the second window comprises a second pair of tracks and a second plurality of rollers to raise and lower the second window. The second pair of tracks of the second means for raising and lowering the second window comprises a third track fixedly attached to an interior left side of the second trash removal frame and a fourth track fixedly attached to an interior right side of the second trash removal frame.

The second plurality of rollers of the second means for raising and lowering the second window comprises a fifth roller fixedly attached via a fifth roller attachment to an interior left bottom corner of the second window, a sixth roller fixedly attached via a sixth roller attachment to an interior left top corner of the second window, a seventh roller fixedly attached via a seventh roller attachment to an interior right bottom corner of the second window, and an eighth roller fixedly attached via an eighth roller attachment to an interior right top corner of the second window. The second window is raised and lowered via the fifth roller, the sixth roller, the seventh roller and the eighth roller traversing simultaneously respectively up and down the third track and the fourth track.

The second means for lifting the second trash container lid is adapted to raise and lower the second trash container lid and comprises a second cable having a first end fixedly attached to the second window and a second end removably attached to the second trash container lid (note: the second trash container is not being set forth as part of the invention). The second means for lifting the second trash container lid is adapted to raise and lower the second trash container lid and the second window simultaneously via the first end of the second cable fixedly attached to an interior bottom edge of the second window and the second end of the second cable that is adapted to be removably attached to the second trash container lid via a second clamp adapted to be held in place via squeezing pressure.

The second means for opening and closing the second door opens and closes the second door via a second plurality of hinges fixedly attached by screws and evenly spaced along an exterior right side of the second door. The second door opens and closes horizontally.

The present invention holds significant improvements and serves as a disposable windows. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, disposable window constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a windows and more particularly to a disposable windows as used to improve the disposing of trash, including garbage and recyclables, through a pair of adjacent windows separated by a spacer into separate outdoor trash containers without having to leave a building.

Generally speaking, the disposable windows are insertable into the side of a building at a location having access to trash containers kept outdoors. The pair of trash removal windows are independently raised via a plurality of rollers simultaneously with the lid of a trash containers so a user can dispose of trash through the opened windows into the trash container. When the windows are closed the lid of each trash container is closed at the same time.

Figure 1:
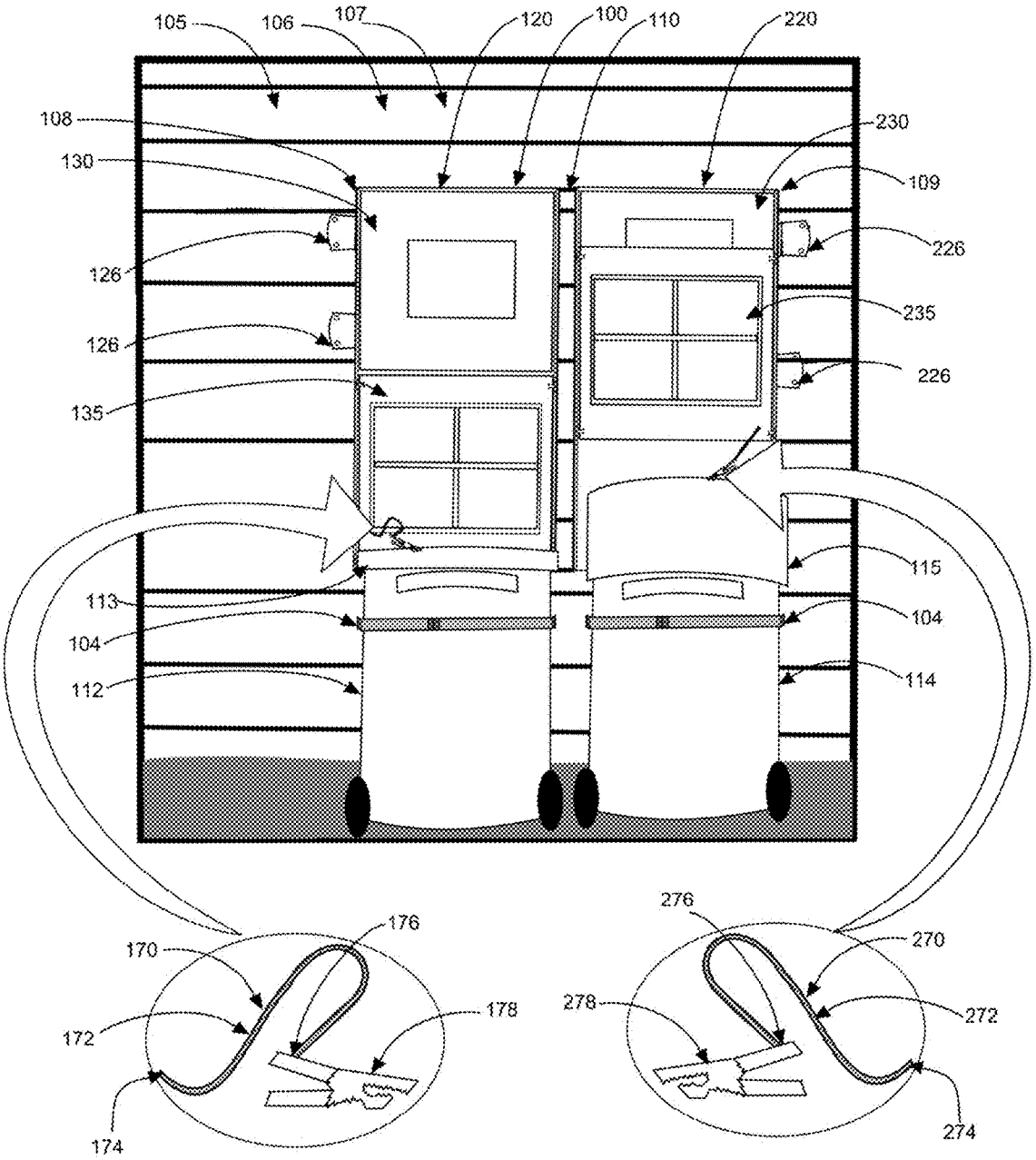
FIG. 1 shows a perspective view illustrating a disposable windows in an in use condition according to an embodiment of the present invention.

Referring to the drawings by numerals of reference there is shown in FIG. 1, a perspective view illustrating disposable windows 100 in an in use condition according to an embodiment of the present invention.

Disposable windows 100 are disclosed herein, in a preferred embodiment, comprising first trash removal frame 120 having first-window 135 and first door 130 is adapted to be fixedly inserted into side 105 of building 106, comprising house 107, via first cut out 108 on side 105 of house 107 and second trash removal frame 220 adapted to be fixedly inserted into side 105 of building 106 via second cut out 109 on side 105 of house 107. Building 106 may also comprise any other structure, such as but not limited to an office building, using outdoor trash containers to dispose of trash. First cut out 108 and second cut out 109 are adapted to be separated by spacer 110 and are adapted to provide an alignment of first trash removal frame 120 with first trash container 112 and the alignment of second trash removal frame 220 with second trash container 114. Each of first trash container 112 and second trash container 114 are secured to house 107 with an adjustable strap 104.

Each of first trash removal frame 120 and second trash removal frame 220 is constructed of wood material and comprise unit width 195, unit height 196, and unit depth 197. Unit depth 197 is adapted and sized to match a standard depth of side 105 of building 106. First trash removal frame 120 and second trash removal frame 220 may also be constructed of any suitable material able to accomplish the purposes of this invention.

Figure 2:
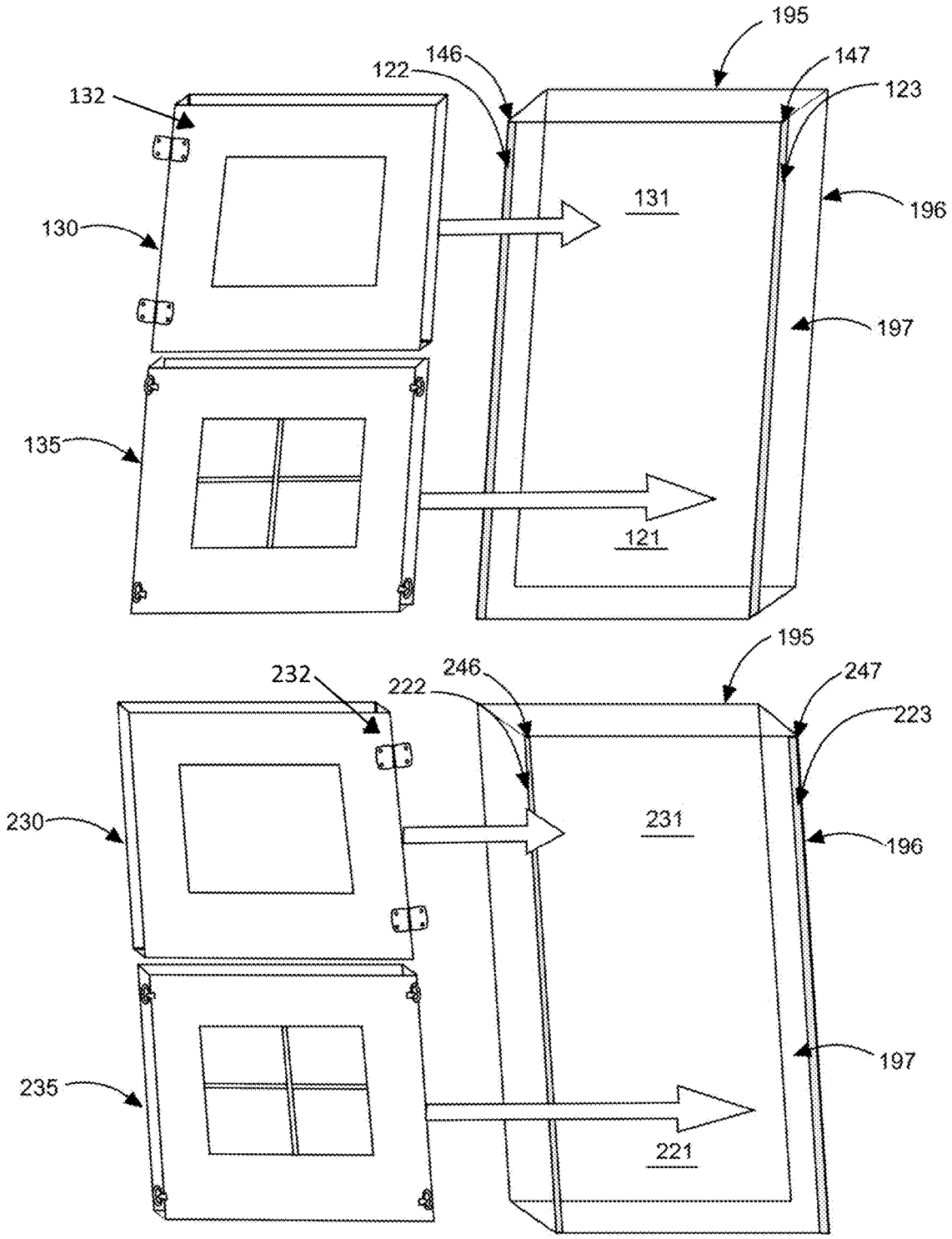
FIG. 2 is a perspective view illustrating a view of disposable windows according to an embodiment of the present invention of FIG. 1.

Referring now to FIG. 2, a perspective view illustrating disposable windows 100 according to an embodiment of the present invention of FIG. 1 is shown.

First window 135 is moveably attached to interior lower half 121 of first trash removal frame 120 and first door 130 is fixedly attached to exterior top half 131 of first trash removal frame 120. First means for opening and closing the first door 130 is done via first plurality of hinges 126 fixedly attached by screws and evenly spaced along exterior left side 132 of first door 130. First door 130 opens and closes horizontally.

Second window 235 is moveably attached to interior lower half 221 of second trash removal frame 220 and second door 230 is fixedly attached to exterior top half 231 of second trash removal frame 220. Second means opens and closes second door 230 via second plurality of hinges 226 fixedly attached by screws and evenly spaced along exterior right side 232 of second door 230. Second door 230 opens and closes horizontally.

Figure 3:
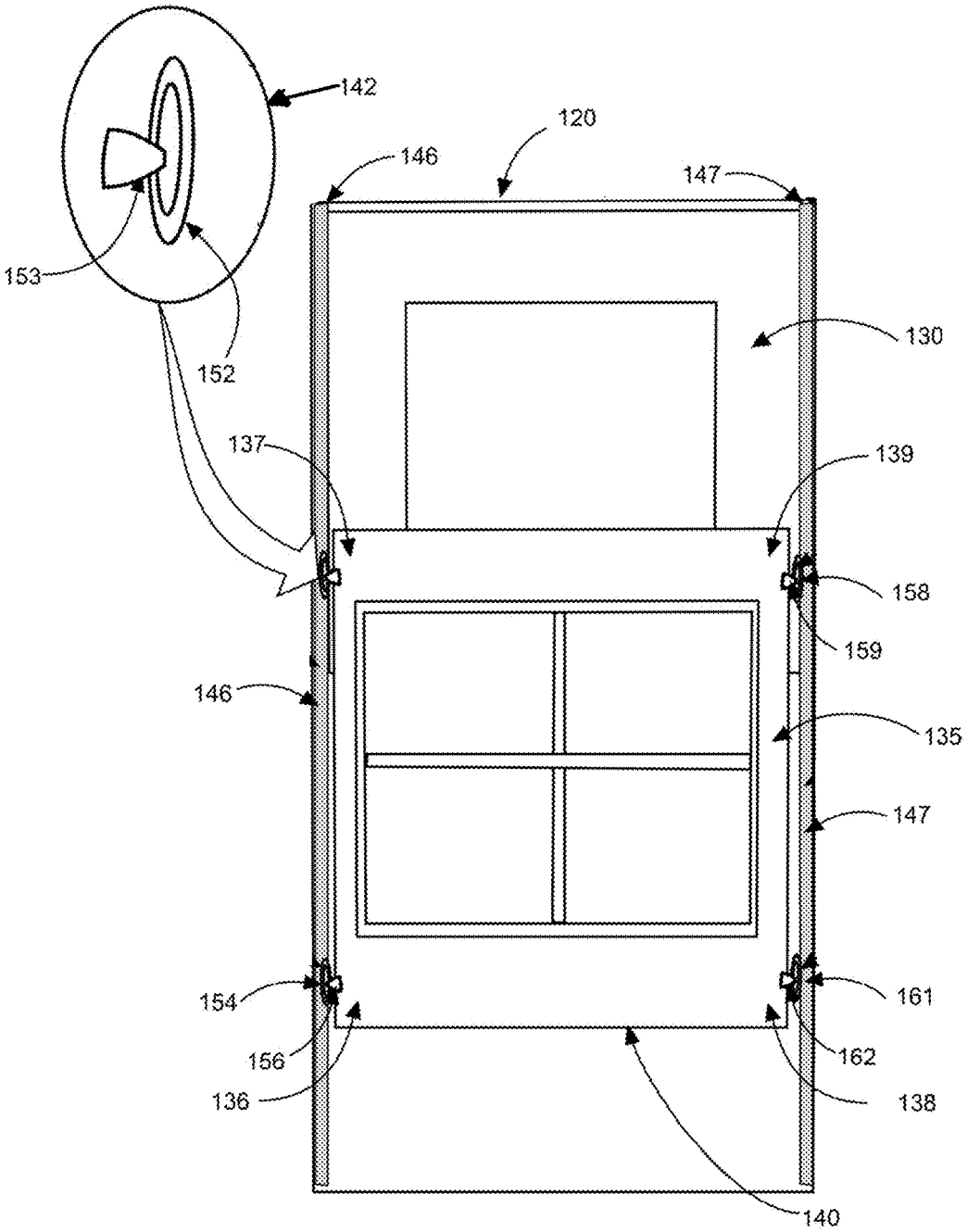
FIG. 3 is a perspective view illustrating an interior view of a first trash removal frame of the disposable window according to an embodiment of the present invention of FIG. 1.

Referring now to FIG. 3, a perspective view illustrating the first trash removal frame 120 of disposable window 100 according to an embodiment of the present invention of FIG. 1.

First trash removal frame 120 includes first window 135 having first means 142 for raising and lowering the first window 135, first means 170 (FIG. 1) for lifting a first trash bin lid 113, and first door 130.

First means 142 for raising and lowering the first window 135 uses a first pair of tracks and first plurality of rollers to raise and lower first window 135. The first pair of tracks of first means 142 for raising and lowering first window 135 comprises first track 146 fixedly attached to interior left side 122 of first trash removal frame 120 and second track 147 fixedly attached to interior right side 123 of first trash removal frame 120.

The first plurality of rollers of first means 142 for raising and lowering the first window 135 comprises first roller 152 fixedly attached via first roller attachment 153 to interior left top corner 137 of first window 135, second roller 154 fixedly attached via second roller attachment 156 to interior left bottom corner 136 of first window 135, third roller 158 fixedly attached via third roller attachment 159 to interior right top corner 139 of first window 135, and fourth roller 161 fixedly attached via fourth roller attachment 162 to interior right bottom corner 138 of first window 135. First window 135 is raised and lowered via first roller 152, second roller 154, third roller 158 and fourth roller 161 traversing simultaneously respectively up and down first track 146 and second track 147. A motor (not shown) may be affixed to first trash removal frame 120 to provide a mechanical means for raising and lowering first window 135.

First means 170 for lifting the first trash bin lid 113 is adapted to raise and lower first trash bin lid 113 and comprises first cable 172 having first end 174 fixedly attached to first window 135 and second end 176 adapted to be removably attached to first trash bin lid 113 (note: the first trash bin is not being set forth as part of the invention). First means 170 for lifting the first trash bin lid 113 is adapted to raise and lower first trash bin lid 113 simultaneously with movement of the first window 135 via first end 174 of first cable 172 fixedly attached to bottom edge 140 of first window 135 and second end 176 of first cable 172 that is adapted to be removably attached to first trash bin lid 113 via first clamp 178 adapted to be held in place via squeezing pressure.

Figure 4:
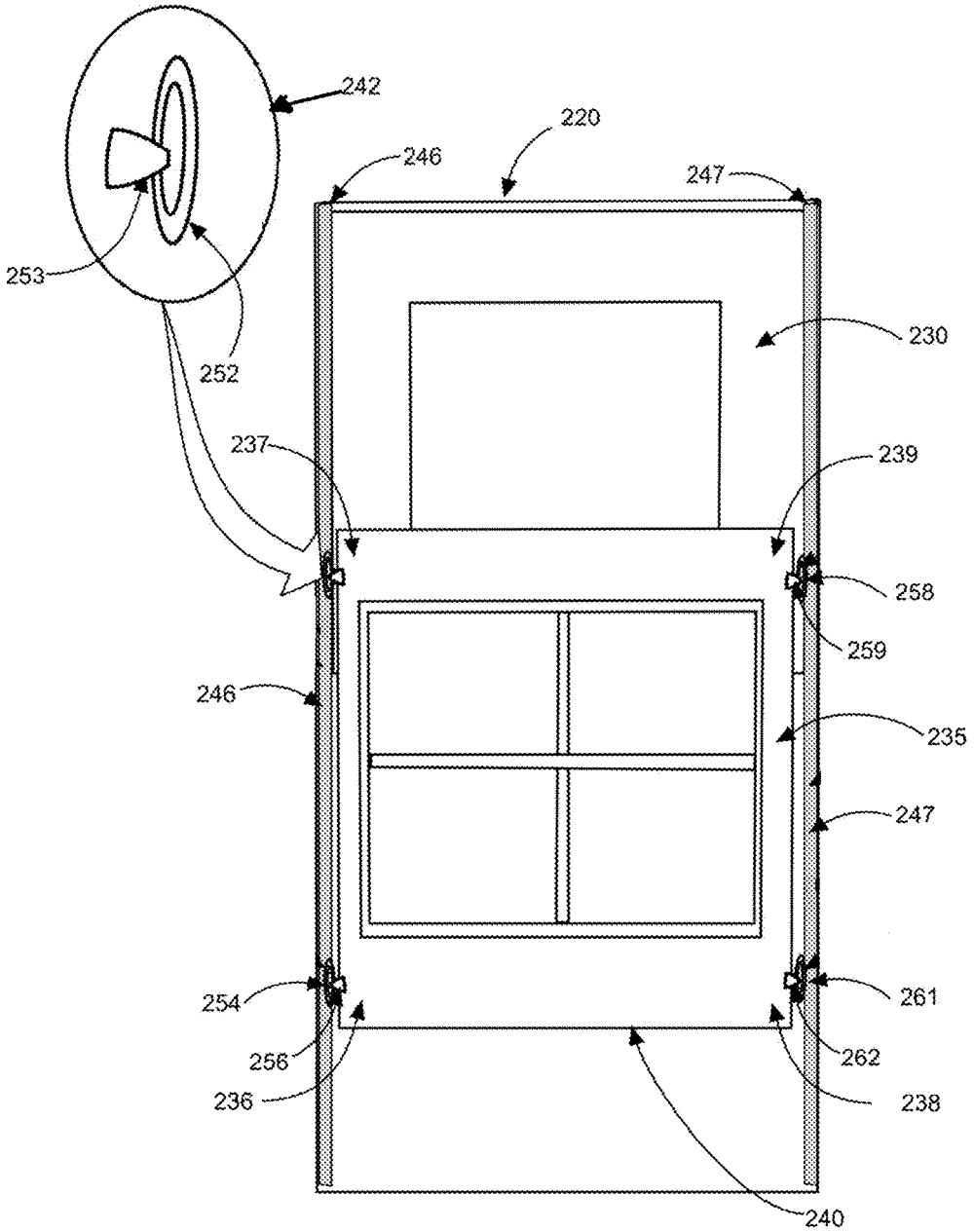
FIG. 4 is a perspective view illustrating an interior view of a second trash removal frame of the disposable window according to an embodiment of the present invention of FIG. 1.

Referring now to FIG. 4, a perspective view illustrating a second window frame 220 of disposable window 100 according to an embodiment of the present invention of FIG. 1 is shown.

Second trash removal frame 220 including second window 235 has second means 242 for raising and lowering the second window 235 and second means 270 (FIGS. 1,5) for lifting a second trash bin lid 115 and second door 230.

Second means 242 for raising and lowering the second window 235 comprises a second pair of tracks and second plurality of rollers to raise and lower second window 235. The second pair of tracks of second means 242 for raising and lowering the second window 235 comprises third track 246 fixedly attached to interior left side 222 of second trash removal frame 220 and fourth track 247 fixedly attached to interior right side 223 of second trash removal frame 220.

The second plurality of rollers of second means 242 for raising and lowering the second window 235 comprises fifth roller 252 fixedly attached via fifth roller attachment 253 to interior left top corner 237 of second window 235, sixth roller 254 fixedly attached via sixth roller attachment 256 to interior left bottom corner 236 of second window 235, seventh roller 258 fixedly attached via seventh roller attachment 259 to interior right top corner 239 of second window 235, and eighth roller 261 fixedly attached via eighth roller attachment 262 to interior right bottom corner 238 of second window 235. Second window 235 is raised and lowered via fifth roller 252, sixth roller 254, seventh roller 258, and eighth roller 261 traversing simultaneously respectively up and down third track 246 and fourth track 247. A motor (not shown) may be affixed to second trash removal frame 220 to provide a mechanical means for raising and lowering second window 235.

Second means 270 for lifting the second trash bin lid 115 is adapted to raise and lower second trash bin lid 115 and comprises second cable 272 having first end 274 fixedly attached to second window 235 and second end 276 removably attached to second trash bin lid 115 (note: the second trash bin is not being set forth as part of the invention). Second means 270 for lifting the second trash bin lid 115 is adapted to raise and lower second trash bin lid 115 simultaneously with movement of second window 235 via first end 274 of second cable 272 fixedly attached to interior bottom edge 240 of second window 235 and second end 276 of second cable 272 that is adapted to be removably attached to second trash bin lid 115 via second clamp 278 adapted to be held in place via squeezing pressure.

Figure 5:
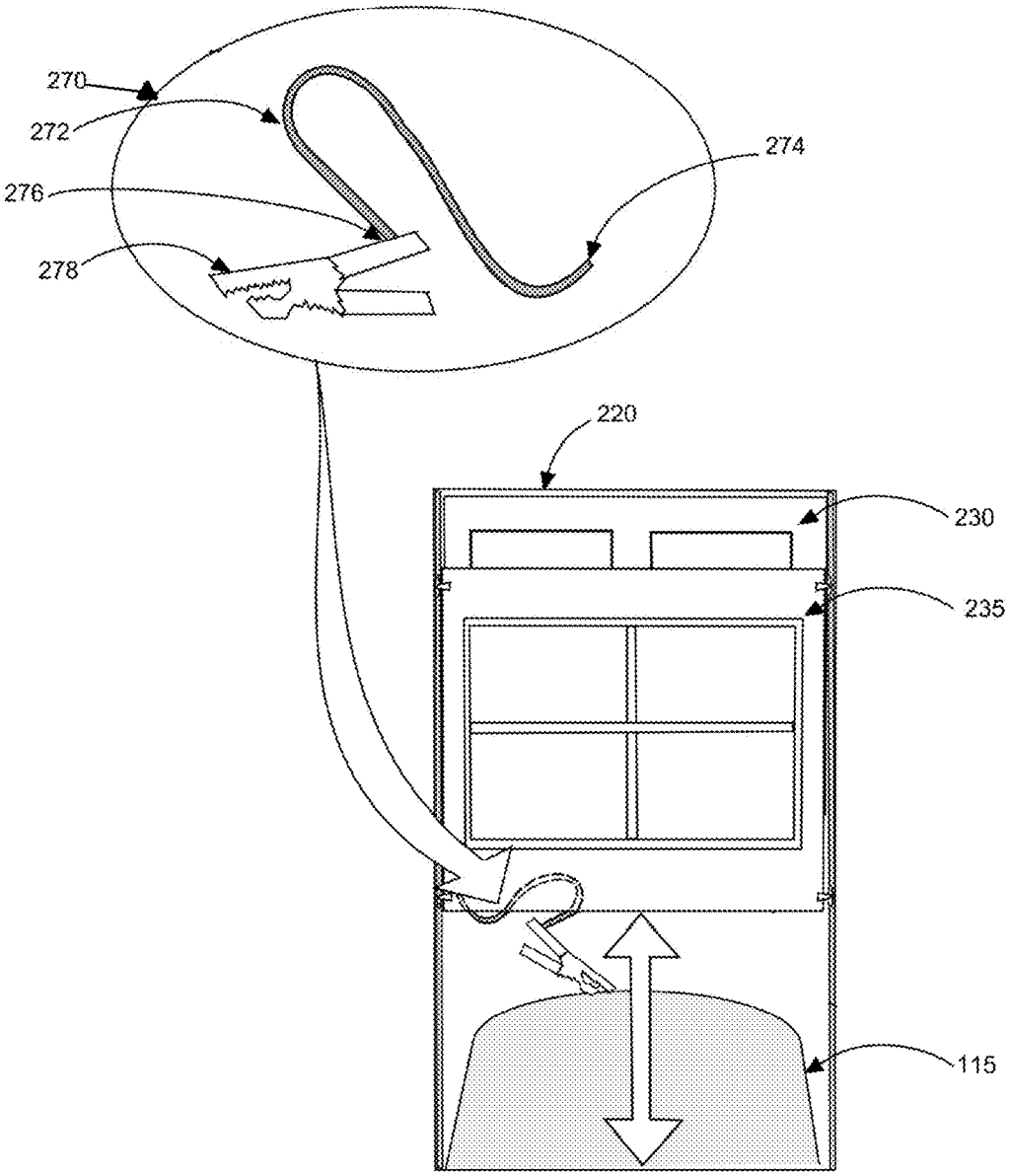
FIG. 5 is a perspective view illustrating an interior view of a disposable window with the second window in a raised condition according to an embodiment of the present invention of FIG. 1.

Referring now to FIG. 5, a perspective view illustrating a disposable window 100 with second window 235 in raised condition according to an embodiment of the present invention of FIG. 1.

Figure 6:
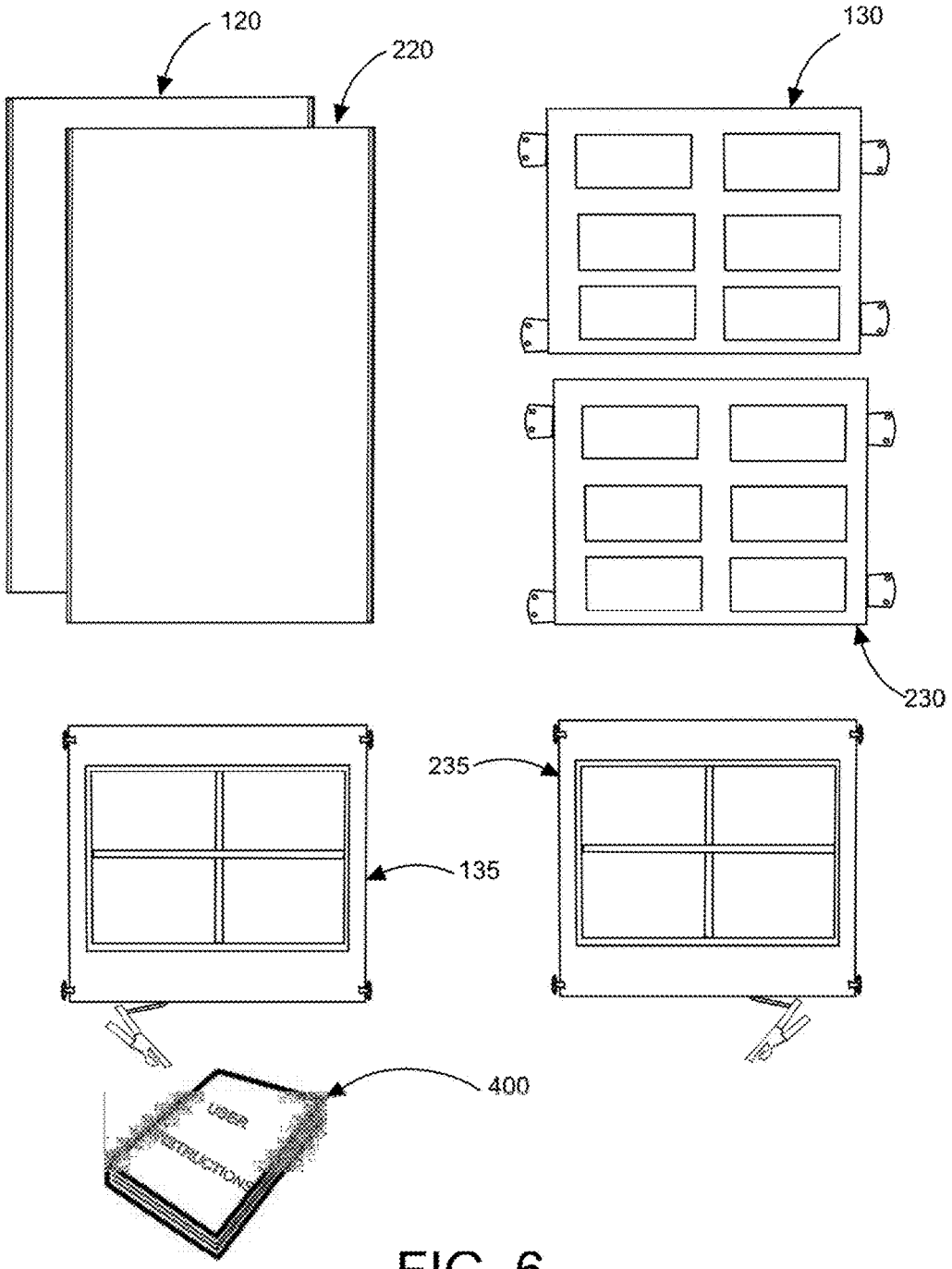
FIG. 6 shows components in kit form of the disposable windows according to an embodiment of the present invention of FIG. 1.

Reference is now made to FIG. 6, showing disposable windows 100. Disposable windows 100 may be sold as a kit comprising the following parts: at least one first trash removal frame 120 having first track 146 and second track 147 (not shown in FIG. 6); at least one first door 130 having first plurality of hinges 126; at least one first-window 135 having first plurality of rollers and first means 170 for lifting a first trash bin lid; at least one second trash removal frame 220 having third track 246 and fourth track 247 (not shown in FIG. 6); at least one second door 230 having second plurality of hinges 226; at least one second window 235 having a second plurality of rollers and second means 270 for lifting a second trash bin lid; and at least one set of user instructions 400. The kit has instructions such that functional relationships are detailed in relation to the structure of the invention (such that the invention can be used, maintained, or the like in a preferred manner). Disposable window 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed:

1. A window apparatus for disposing of garbage therethrough and adapted to be inserted into a side of a building, said window apparatus comprising:

a first trash removal frame including a first window;

wherein said first window is moveably attached to an interior lower half of said first trash removal frame;

wherein said first trash removal frame includes a first pair of tracks and said first window includes a first plurality of rollers for guiding said first window as said first window is raised and lowered;

a first cable having a first end fixedly attached to said first window and a second end adapted to be removably attached to a first trash bin lid;

a first door fixedly attached to an exterior top half of said first trash removal frame via at least one hinge member; and a second trash removal frame including a second window;

wherein said second window is moveably attached to an interior lower half of said second trash removal frame;

wherein said second trash removal frame includes a second pair of tracks and said second window includes a second plurality of rollers for guiding said second window as said second window is raised and lowered;

a second cable having a first end fixedly attached to said second window and a second end adapted to be removably attached to a second trash bin lid; and a second door fixedly attached to an exterior top half of said second trash removal frame via at least one hinge member.

2. The window apparatus of claim 1 wherein said first pair of tracks of said first trash removal frame comprises a first track fixedly attached to an interior left side of said first trash removal frame and a second track fixedly attached to an interior right side of said first trash removal frame.

3. The window apparatus of claim 1 wherein said first plurality of rollers comprises a first roller fixedly attached via a first roller attachment to a left bottom corner of said first window, a second roller fixedly attached via a second roller attachment to a left top corner of said first window, a third roller fixedly attached via a third roller attachment to a right bottom corner of said first window, and a fourth roller fixedly attached via a fourth roller attachment to a right top corner of said first.

4. The window apparatus of claim 1 wherein said first trash bin lid is adapted to be raised and lowered simultaneously with said first window via said first end of said first cable being fixedly attached to a bottom edge of said first window and said second end of said first cable being adapted to be removably attached to said first trash bin lid via a clamp.

5. The window apparatus of claim 1 wherein each of said first window and said second window include a window pane, a horizontal divider for said window pane and a vertical divider for said window pane.

* * * * *